US006305670B1

(12) United States Patent
Ward et al.

(10) Patent No.: US 6,305,670 B1
(45) Date of Patent: Oct. 23, 2001

(54) RAILING ASSEMBLY

(76) Inventors: Larry E. Ward; Deanna L. Ward, both of 3015 Saddlebrook Dr., Findlay, OH (US) 45840; Kofi Ofosu-Asante, 1535 Cedar Ave., Cincinnati, OH (US) 45224

( * ) Notice: Subject to any disclaimer, the term of this patent is extended or adjusted under 35 U.S.C. 154(b) by 2 days.

(21) Appl. No.: 08/956,160

(22) Filed: Oct. 22, 1997

Related U.S. Application Data

(60) Provisional application No. 60/028,748, filed on Oct. 22, 1996.

(51) Int. Cl.[7] ..... E04H 17/14

(52) U.S. Cl. ..... 256/59; 256/65

(58) Field of Search ..... 256/19, 59, 65, 256/66, 68, 69; 52/720.2, 731.1, 731.2, 731.4, 736.3, 301

(56) References Cited

U.S. PATENT DOCUMENTS

| | | | | |
|---|---|---|---|---|
| 1,797,883 | * | 3/1931 | Strubel | 256/65 X |
| 2,748,954 | | 6/1956 | Murren . | |
| 2,820,262 | | 1/1958 | Dunn . | |
| 3,381,427 | | 5/1968 | Watson . | |
| 3,596,880 | * | 8/1971 | Greenberg | 256/59 X |
| 4,035,978 | * | 7/1977 | Bajorek et al. | 52/720.2 |
| 4,381,160 | | 4/1983 | Grimm et al. . | |
| 4,641,467 | | 2/1987 | Dupuis, Jr. . | |
| 4,928,930 | * | 5/1990 | Chung | 256/65 X |
| 4,972,642 | | 11/1990 | Strobl, Jr. . | |
| 5,029,820 | * | 7/1991 | Katz | 256/59 |
| 5,035,401 | * | 7/1991 | Solter | 256/59 X |
| 5,437,433 | * | 8/1995 | Rezek | 256/59 X |
| 5,605,023 | * | 2/1997 | Biernazki | 52/301 |
| 5,626,331 | * | 5/1997 | Erwin | 256/59 |

* cited by examiner

*Primary Examiner*—Lynne H. Browne
*Assistant Examiner*—John R. Cottingham
(74) *Attorney, Agent, or Firm*—Donald R. Fraser

(57) ABSTRACT

A railing assembly including a top rail, a bottom support, a plurality of spaced apart hollow plastic balusters, and supporting brackets affixed to the facing surfaces of the top rail and bottom support for receiving the upper and lower ends of the baluster respectively. A reinforcing tube is employed for rigidizing the baluster.

2 Claims, 2 Drawing Sheets

RAILING ASSEMBLY

This application claims benefit to provisional application 60/028,748 Oct. 22, 1996.

BACKGROUND OF THE INVENTION

1. Field of the Invention

The present invention relates generally to balusters used as components for railing assemblies for decks, porches, walkways, stairways, and any other applicable uses for railing systems.

2. Description of the Prior Art

The prior art discloses certain structures for suitably supporting the base of columnar members. For example, a U.S. Pat. No. 2,748,954 to Muren discloses a base for a columnar element wherein the bottom of the inner post is received within an appropriate recess in a base member having sloping side walls. The disclosure states that the components may be formed of a standard material, such as plastic. A U.S. Pat. No. 2,820,262 to Dunn shows a base sleeve formed of cast aluminum for receiving the lower end of a column. The sleeve is threadably secured to the floor by screws. A U.S. Pat. No. 3,381,427 to Watson shows a flanged supporting structure which receives the lower portion of a column. Threaded fasteners are employed to secure the supporting structure to a supporting base medium. A U.S. Pat. No. 4,381,160 to Grimm et al. discloses a post support bracket assembly including four corner brackets which cooperate to receive and support the lower end of a support post or newel. A U.S. Pat. No. 4,641,467 to Dupuis, Jr. shows a column construction wherein the ends of the column are hollow and are adapted to receive appropriately formed circular keys. A U.S. Pat. No, 4,972,642 to Strobl, Jr. shows a plastic footing for a generally vertically extending post. A U.S. Pat. No. 5,481,846 to Macchietto discloses a supporting device for an elongate pole wherein the bottom thereof is received within a suitably formed opening of a base plate.

There is additional prior art disclosing various railing assemblies wherein at least a mention is made in certain portions of the disclosures that a plastic material may be used in fabricating the substituent parts.

SUMMARY OF THE INVENTION

It is an object of the present invention to product a railing assembly including balusters and associated support brackets for fastening the respective ends of the balusters to the upper and lower rail members.

Another object of the invention is to produce a railing assembly employing an array of spaced apart hollow balusters which may be readily provided with internal reinforcing means.

Still another object of the invention is to produce baluster support brackets capable of militating against relative movement between the associated baluster and support rail to which the brackets are attached.

Still a further object of the invention is to produce a railing assembly including support brackets which may be readily affixed to associated rails formed by native wood, wood composites, and rigid plastic materials, for example.

It is still another object of the invention to produce a railing assembly including support brackets for the associated balusters which enable the balusters to be suitably supported relative to the upper and lower rail members and prevent direct contact between the balusters and the rail members.

The above objectives are achieved by a railing assembly including a top rail, a bottom support, a plurality of spaced apart plastic balusters having upper and lower ends, and supporting brackets for receiving the upper and lower ends of the balusters and securing the balusters to the top rail and the bottom support.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawings, in which.

DETAILED DESCRIPTION OF THE PREFERRED EMBODIMENT

Figure 1:
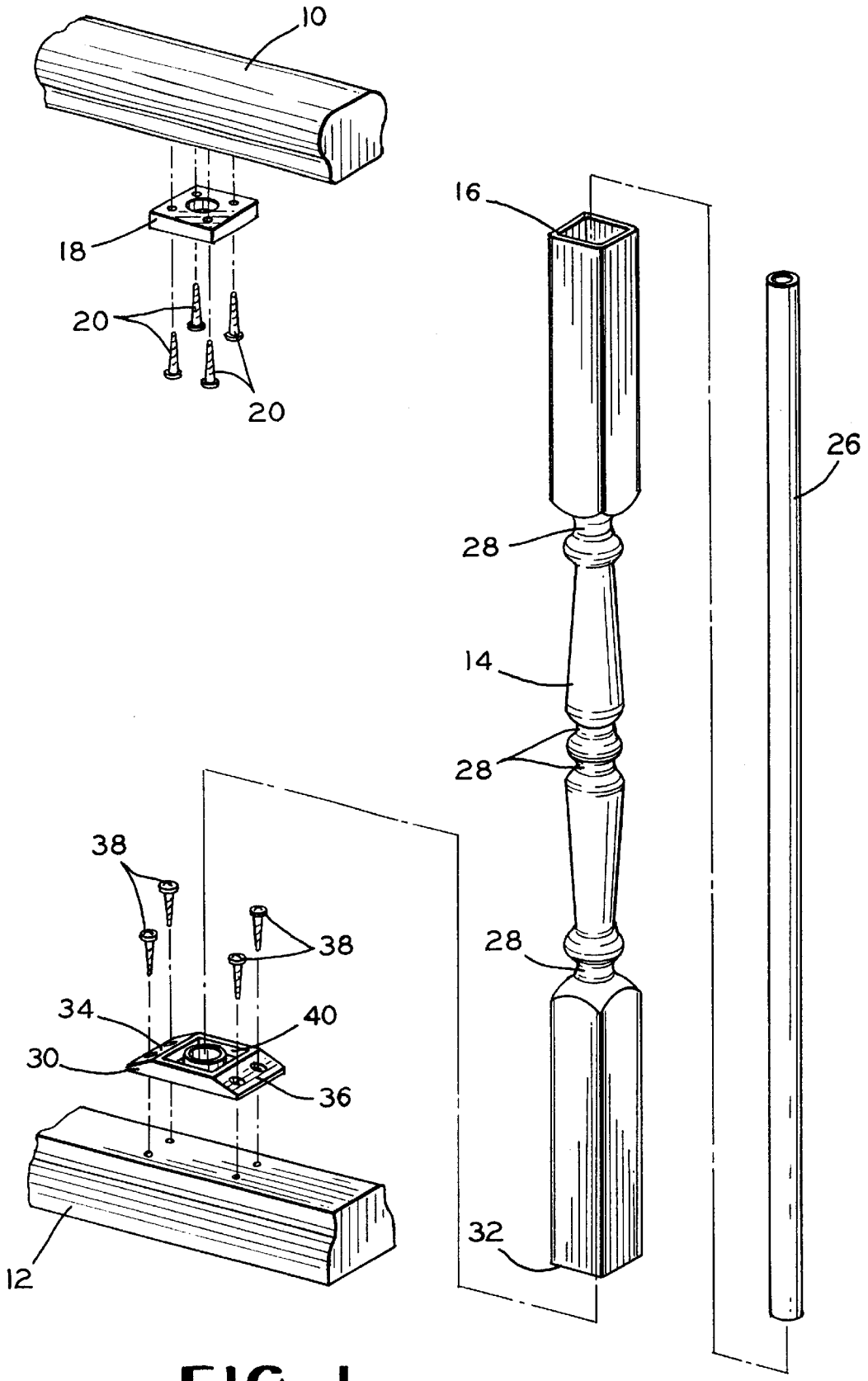
FIG. 1 is an exploded perspective view of baluster incorporating the features of the present invention together with upper and lower support brackets and an associated reinforcing member.
Figure 2:
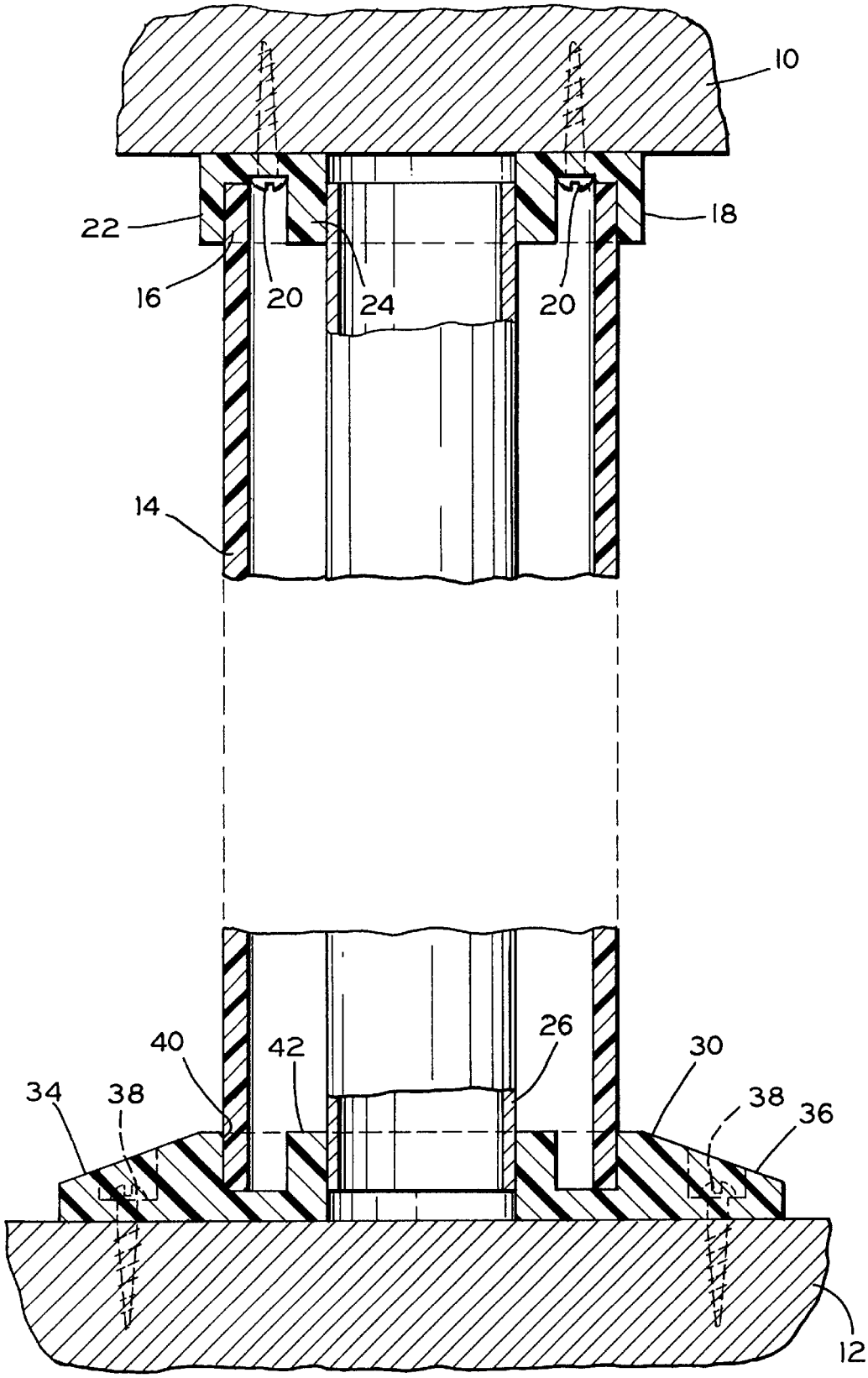
FIG. 2 is a fragmentary sectional view of the upper and lower ends of the baluster illustrated in FIG. 1 with the respective supporting brackets in operative installed position.

Referring to the drawings, there is illustrated a typical railing assembly for use with decks, porches, and walkways and includes spaced apart horizontally extending upper rail member 10 and lower rail member 12. Typically, the ends of the rail members 10, 12 are attached to spaced apart vertically extending end posts (not shown).

The railing assembly typically includes an array of spaced apart balusters 14, only a single one of which is disclosed since each of the balusters is identical with the others. The baluster 14 is comprised of polyethylene and is formed by a well-known blow molding process. The upper end 16 of the hollow baluster 14 affixed to the upper rail 10 by a support bracket 18. The bracket 18 is typically provided with a series of apertures for receiving threaded fasteners 20. The fasteners 20 are suitably screwed into the upper rail member 10 to secure the bracket 18 thereto.

The bracket 18 is provided with marginal wall 22. The inner surface of the wall 22 is formed of substantially the same configuration as the outer surface of the upper end 16 of the baluster 14. The central portion of the bracket 18 is provided with an aperture defined by an annular wall 24. The aperture defined by the inner surface of the annular wall 24 is adapted to receive one end of a reinforcing tube 26.

The reinforcing tube 26 is adapted to extend completely through the interior of the hollow baluster 14 and provides for additional strength of the baluster 14 tending to militate against any bowing of the baluster 14 which could otherwise occur by an infant attempting to place its head between adjacent balusters. The decorative features of the baluster 14 include spaced apart annular sections 28, for example, the interior surfaces of which rather snugly receive the reinforcing tube 26. Therefore, it will be appreciated that the preferred dimensions of the outer diameter of the tube 26 should approximate the diameter of the inner surfaces of the annular sections 28.

A support bracket 30 is provided to support the lower end 32 of the hollow baluster 14. The bracket 30 is typically provided with a series of apertures formed in oppositely extending ramp shaped webs 34, 36. The apertures are provided to receive threaded fasteners 38. The threaded fasteners 38 are adapted to extend through respective apertures and screwed into the lower rail member 12 to secure the bracket 30 thereto.

The bracket 30 is provided with a marginal wall 40 which defines the innermost edges of the webs 34, 36 and formed opposing sides for the bracket 30. The inner surface of the wall 40 is formed of substantially the same configuration as the outer surface of the lower end 32 of the baluster 14. The central portion of the bracket 30 is provided with an aperture defined by an annular wall 42. The aperture defined by the inner surface of the annular wall 42 is adapted to receive other end of the reinforcing tube 26.

It will be noted that the supporting brackets 18 and 30 are suitably affixed to the respective rails 10 and 12 and function to adequately militate against any movement of the baluster 14 relative to the rails 10 and 12. With the ends of the reinforcing tube 26 properly secured by the supporting brackets 18 and 30, it will be appreciated that the entire baluster 14 is immobilized. Obviously, in the event the balusters could bow, even slightly, this could permit a child's head to be inserted between two adjacent balusters causing traumatic results.

The installation of the assembly is typically achieved in the following sequence of steps. Initially, the support bracket 18 is fastened to the underside of the upper rail 10 by inserting the threaded fasteners 20 through suitable apertures with bracket 18 and thence screwed into the undersurface of the rail 10.

Next, the lower support bracket 30 is fastened to the upper surface of the bottom rail 12 by inserting the threaded fasteners 38 through the suitable apertures in the bracket 30 and thence screwed into the bottom support 12.

It will be appreciated that by flexing the upper rail 10 in an upward direction, the ends of the baluster 14 and the associated reinforcing tube 26 may be sequentially disposed into the respective supporting bracket 18, 30.

As an alternative method of installation, the upper supporting bracket 18 may be initially affixed to the under surface of the top rail 10. The upper ends of the baluster 14 and associated reinforcing tube 26 are simultaneously disposed within the supporting bracket 18. Next, the supporting bracket 30 is properly disposed on the lower ends of the baluster 14 and the reinforcing tube 26 and the assembly is slid into place on the lower support 12. Once in place, the threaded fasteners 38 are caused to be screwed through the appropriate apertures in the lower supporting bracket 30. Thus, the assembly is properly permanently secured.

While specific mention has been made of utilizing the support bracket 18 for the upper end of the baluster 14 and the support bracket 30 for the lower end of the baluster 14, other combinations may be satisfactorily employed. In certain installations, the arrangement could be reversed. The support bracket 18 could be used at the bottom and the support bracket 30 could be used at the top. Also, the use of the support bracket 18 or 30 could be selected for use on either end simultaneously, i.e., support bracket 18 on both ends of the baluster 14; or the support bracket 30 on both ends of the baluster 14.

While mention has been made that the balusters 14 are preferably formed of polyethylene, it will be understood that other plastic materials, such as for example polyvinylchloride, may be used without departing from the spirit of the present invention. Likewise, the supporting brackets 18, 30 are preferably formed of a compatible plastic material such as polyethylene or polyvinylchloride, for example.

While the preferred embodiment of the invention includes a reinforcing tube, it will be understood that there are certain circumstances in which such means is not necessary. For example, the material from which the baluster 14 is formed could contain sufficient inherent strength to withstand any forces tending to cause the balusters to bow.

Also, the baluster 14 may be employed in certain environments where the upper and lower ends are installed in apertures formed in the facing surfaces of the upper rail and the lower supporting surfaces.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. In a railing assembly including a top rail, a bottom support, and a plurality of hollow plastic balusters having upper and lower ends, a hollow reinforcing tube having an upper end and a lower end extending through the hollow interior of the balusters, and support means mounting the balusters in spaced apart relation between the top rail and bottom support, and retaining the respective ends of the reinforcing tube, the improvements comprising the support means for receiving the upper end of the baluster and including a first support bracket secured to the top rail and including a base portion provided with an aperture, an annular wall surrounding the aperture and extending from the first base portion for receipt of one end of the reinforcing tube; and a second support bracket secured to the bottom support and including a second base portion provided with an aperture, an annular wall surrounding the aperture and extending from the second base portion for receipt of the other end of the reinforcing tube.

2. A railing assembly as defined in claim 1, wherein at least one of said first or said second support bracket includes outwardly extending web means for receiving fastening means for securing said support bracket to said top rail or said bottom support.

* * * * *